US005401007A

United States Patent [19]

Dabney et al.

[11] Patent Number: 5,401,007

[45] Date of Patent: Mar. 28, 1995

[54] WIRE SPRING ASSEMBLIES MADE OF NESTABLY STACKABLE HALF UNITS

[75] Inventors: Upton R. Dabney; William C. Rodgers, both of Lexington, Ky.

[73] Assignee: Hoover Group, Inc., Alpharetta, Ga.

[21] Appl. No.: 235,861

[22] Filed: May 2, 1994

[51] Int. Cl.[6] ..... F16F 3/00

[52] U.S. Cl. ..... 267/103; 5/247; 5/252; 5/255

[58] Field of Search ..... 267/81, 103, 83, 84, 267/86, 88; 5/8, 476, 247, 255, 252, 257, 263, 267, 268

[56] References Cited

U.S. PATENT DOCUMENTS 1,703,587 2/1929 Kraft ..... 5/252
4,730,358 3/1988 Zapletal ..... 5/247
4,790,038 12/1988 Ikeda .
4,862,531 9/1989 Wells .
4,942,636 7/1990 Scott ..... 5/247
5,246,210 9/1993 Dabney ..... 267/103

*Primary Examiner*—Robert J. Oberleitner
*Assistant Examiner*—Clifford T. Bartz
*Attorney, Agent, or Firm*—Harness, Dickey & Pierce

[57] ABSTRACT

Wire spring assemblies for use in furniture items such as mattresses and seat cushions are made of two half units. The half units include spring elements extending from a generally planar deck with the spring elements containing complementary connecting structures at their distal ends which enable the half units to be assembled together by inverting one half unit relative to the other, aligning the two half units and snap-fitting the connecting structures of the spring elements together to form a double sided mattress or seat core. The assemblies are then upholstered in a normal fashion.

14 Claims, 4 Drawing Sheets

WIRE SPRING ASSEMBLIES MADE OF NESTABLY STACKABLE HALF UNITS

BACKGROUND AND SUMMARY OF THE INVENTION

The present invention relates to wire spring assemblies for use in furniture items such as mattresses and seat cushions and in particular to wire spring assemblies made from a pair of nestably stackable half units.

Wire spring assemblies for use in mattresses, seat cushions and the like are usually comprised of coil springs, continuous or individual, aligned in rows that form a generally rectangular shape. Lacing wires on the top and bottom surfaces of the coil springs hold the coil springs in place, providing a yieldable wire spring assembly. The wire spring assemblies are typically shipped from the wire manufacturer to upholstery plants for finish manufacturing where padding and a cover are added to finish the furniture articles.

The most common method of bulk packaging of the coil spring wire cores is baling. One bale typically includes 15 to 20 spring assemblies fully compressed. Crating material on the top and bottom of a bale provides the rigid surface structure necessary to contain the assemblies. Heavy wire ties are used throughout the edges, ends and center to keep the assemblies from decompressing to their free state. The baling process is reversed at the upholstery plants. Heavy equipment is required in both locations in order to control the very large loads involved in both baling and unbaling. The process is slow, expensive and sometimes dangerous.

Accordingly, it is one object of the present invention to provide a wire spring assembly that can be easily baled and transported without the necessity of compressing the springs while at the same time reducing the space that is required to ship the spring assemblies in a relaxed state.

The wire spring assemblies of the present invention are comprised of two half units. The two half units are assembled together by inverting one unit relative to the other, aligning the two half units and locking then together to form a double sided mattress or seat core. The assemblies are then upholstered in a normal fashion. The half units can be configured to be locked together with or without the use of tools.

Each half unit is comprised of a generally planar rectangular deck from which a plurality of spring elements depend. The spring elements include attaching portions at one end which are used to attach the spring elements to the deck by winding the lacing wires around the spring attaching portions. The spring elements extend from the attaching portions to distal ends spaced from the deck. The distal ends of the spring elements are formed with complementary connecting structures that enable the spring elements of one half unit to snap-fit together with the spring elements of another half unit. This snap-fit connection joins the two half units together, forming the wire spring assembly.

The spring elements are preferably tapered from the deck to the distal ends to permit nestable stacking of the half units. As a result, a plurality of half units can be stacked together in a bale, significantly reducing the space needed for shipping a bale without compressing the spring elements.

Further objects, features and advantages of the invention will become apparent from a consideration of the following description and the appended claims when taken in connection with the accompanying drawings.

DETAILED DESCRIPTION OF THE PREFERRED EMBODIMENT

Figure 1:
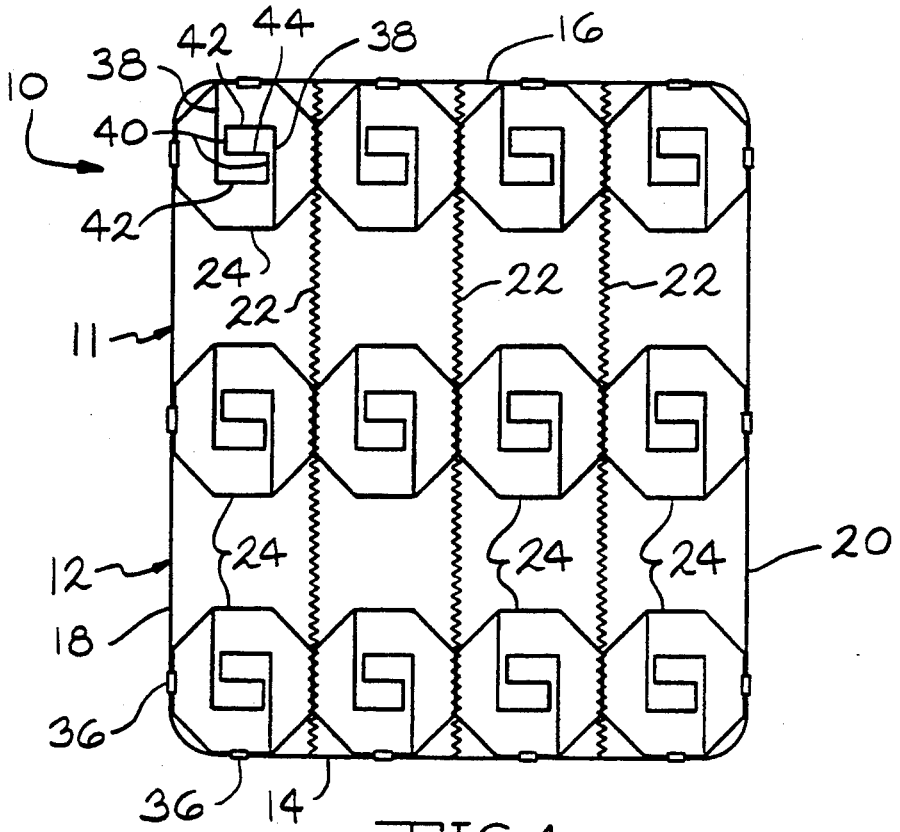
FIG. 1 is a single line schematic top view of one half unit of the wire spring assembly according to the present invention.

One half unit of the wire spring assembly of the present invention is shown in FIG. 1 and designated generally at 10. Half unit 10 includes a planar deck 11 which is made of a rectangular border wire 12 having four sides, spaced opposite sides 14 and 16 and spaced opposite sides 18 and 20 and a plurality of coil lacing wires 22 extending between the spaced sides of the border wire in a generally parallel fashion. The ends of the lacing wires are attached to the border wire in a conventional manner by clips or by welding. While the half unit 10 is shown as being rectangular, it will be apparent to those skilled in the art that the particular shape of the spring assembly can be varied as desired for the particular furniture article being constructed.

Attached to the deck 11 and extending into the paper of FIG. 1, are a plurality of spring elements 24. The spring elements 24 are formed at their distal ends with connecting structures which enable mating spring elements, as described below, to be coupled to one another at their distal ends. A pair of half units 10, with one half unit being inverted relative to the other, are joined together by the connecting structures at the distal ends of the spring elements to form a completed wire spring assembly having two spaced decks 11 and springs extending therebetween. The two half units are substantially identical to one another with the only difference between half units being the mating connecting structures of the spring elements 24.

Figure 2:
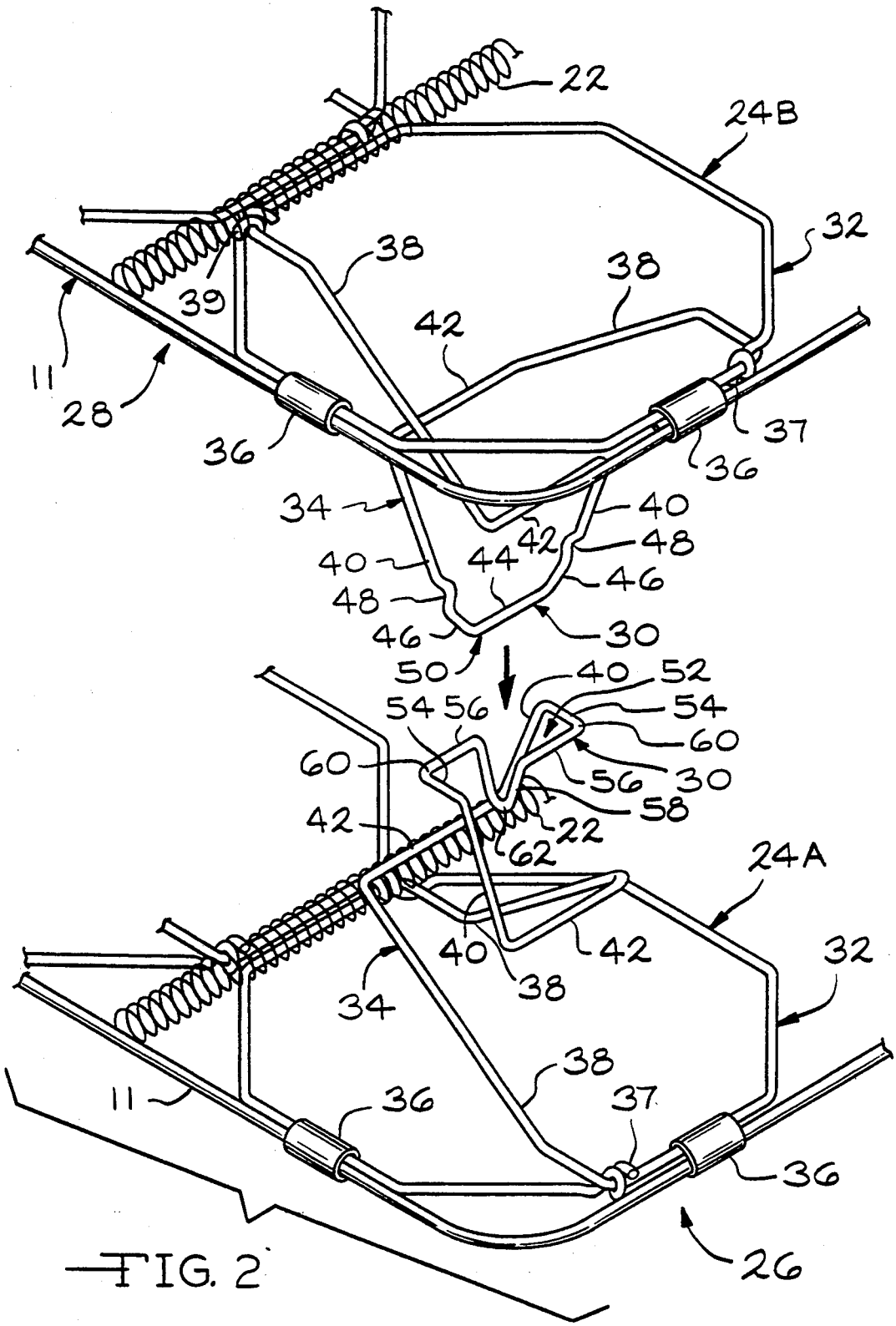
FIG. 2 is an exploded fragmentary perspective view showing the spring elements of the two half units spaced from one another and aligned for attachment to one another.

Two half units are shown in FIG. 2 in position for coupling to one another. The lower half unit is designated as half unit 26 while the upper half unit is designated as half unit 28. Lower half unit 26 is shown with a spring element 24A while the upper half unit 28 is shown with a spring element 24B. The lower half unit 26 has been inverted relative to the upper half unit 28 such that the spring element 24A extends upwardly from the deck 11 while the spring element 24B extends downwardly from the deck 11 of upper half unit 28.

The spring elements 24 are each made from a single piece of wire and are comprised generally of a distal end portion 30, a proximal end portion 32 and a center portion 34. The proximal end portions 32 are generally octagonal in shape and lie within the plane of deck 11. The spring elements in the corner of the wire spring assemblies, as shown in FIG. 2, have two octagonal sides attached to the border wire by clips 36 and another octagonal side wound within a lacing wire 22. Other spring elements, as shown in FIG. 1, may have two of the octagonal sides wound within the lacing wires and may be attached to the deck solely by the lacing wires. The proximal end portions thus serve as attaching portions for attaching the spring elements to the deck.

Figure 3:
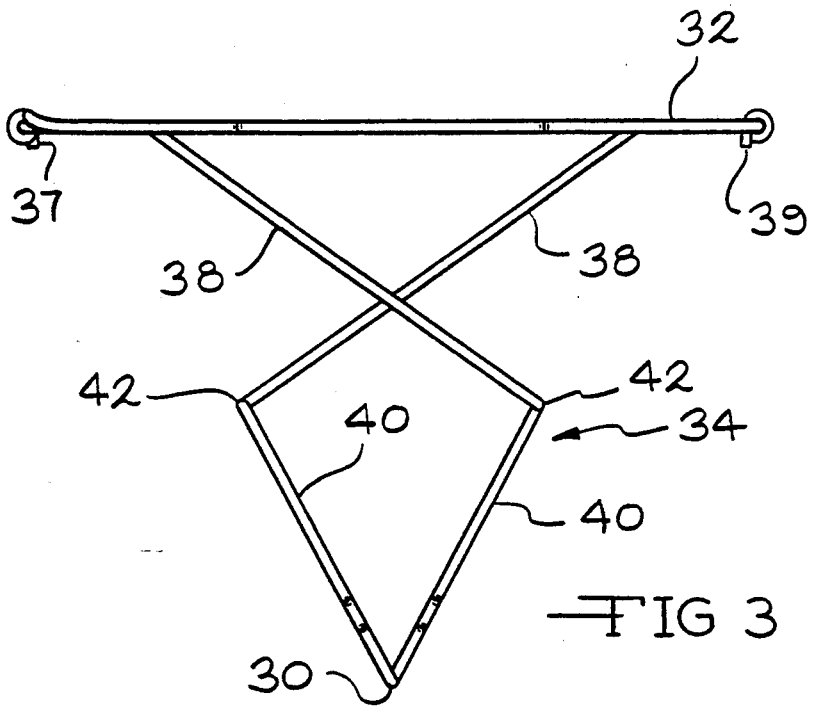
FIG. 3 is a side elevational view of a spring element.

The center portion 34 of the spring elements includes a pair of legs each having connecting bars 38 and 40 and a center torsion bar 42. Connecting bars 38 extend between the center torsion bar and the proximal end portions 32 and are oriented in a crossing fashion as viewed from the side shown in FIG. 3. The center torsion bars 42 extend horizontally from the connecting bars 38. Connecting bars 40 extend from the center torsion bars 42 to the distal end portion 30. Connecting bars 40 taper downward from the center torsion bars 32 in a V-shape nature as shown in FIG. 3 and terminate at the distal end portion 30.

The two ends 37 and 39 of the wire forming the spring elements are both at the proximal end portion of the spring elements. At the top of one connecting bar 38, the wire extends around the proximal end portion to the top of the opposite connecting bar where the wire ends.

The two spring modules 24A and 24B are identical except for the distal end portions 30. The different distal end portions 30 provide complementary connecting structures enabling the distal ends of the spring elements 24A and 24B to be coupled to one another without the use of separate fasteners. The distal end structures will be described in greater detail below.

Figure 4:
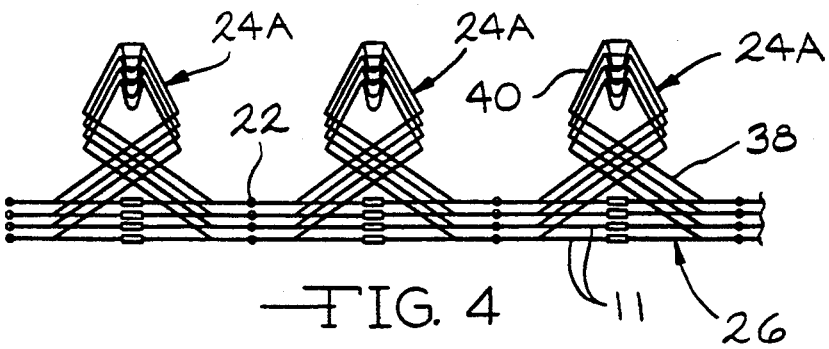
FIGS. 4 and 5 are single line schematic elevational views of lower and upper half units respectively illustrating the nestably stackable nature of the half units.
Figure 5:
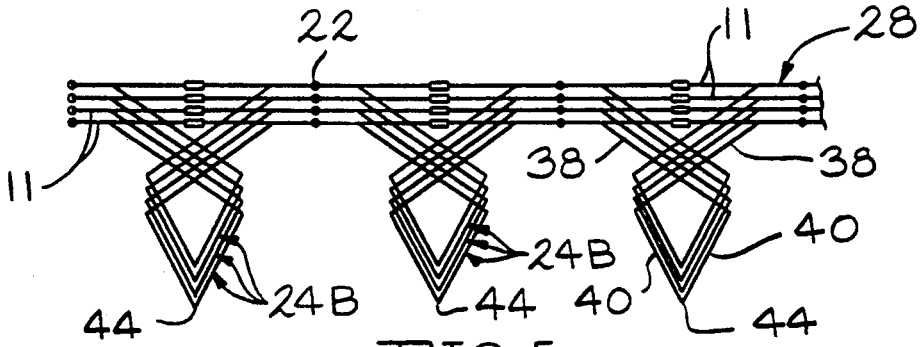

One advantage of the wire spring assembly half units is their stackability. As is particularly evident from FIGS. 2 and 3, the cross sectional area swept out by the various portions of the spring elements 24 increases progressively from the distal end portion 30 to the proximal end portion 32. This provides an unobstructed inside cavity outlined by the spring elements. This configuration allows the spring units to be stacked together in a dense form, thus providing for efficient packaging and shipping. When the spring elements are connected to the decks 11 of the half units, and the center of the octagonally shaped proximal end portions 32 are left unobstructed as shown in FIG. 1, the half units 26 and 28 are nestably stackable as shown in FIGS. 4 and 5. When stacked, the spring elements from one half unit are nestably received within the spring elements of the half unit therebelow.

The nestably stackable nature of the half units enables the half units to be conveniently and efficiently shipped from a wire manufacturer to a furniture manufacturer where the two half units are assembled as described below and finished into a furniture article with the addition of padding and a cover. The shipping of the stacked half units is accomplished without compression of the spring elements and the need for heavy equipment necessary in the baling process.

Figure 6:
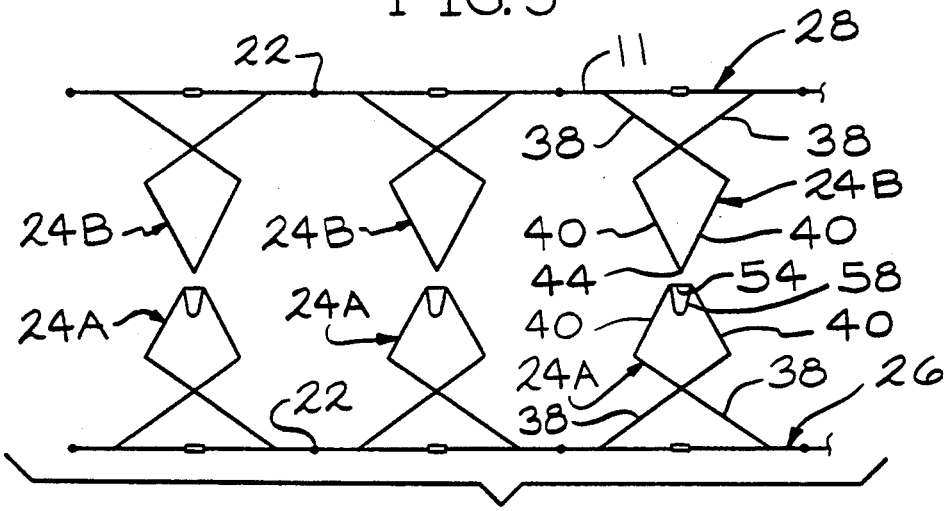
FIG. 6 is a single line schematic elevational view of a upper and lower half units, in alignment for attachment to one another.
Figure 7:
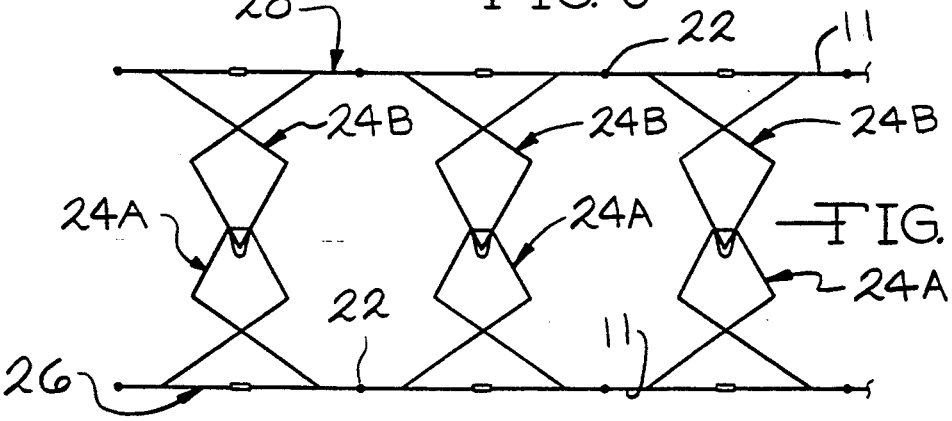
FIG. 7 is a single line schematic elevational view similar to FIG. 6 showing the two half units attached to one another.

With reference to FIG. 6, a lower half unit 26 is shown in an inverted position with the spring elements extending upwardly from the deck 11 while an upper half unit 28 is positioned thereabove with the spring elements 24B extending downward and aligned with the spring elements 24A of the lower half unit. The two half units are then pressed together until the connecting structures are snap-fit together.

Each spring element 24B has a torsion bar 44 forming the distal end portion 30 extending between the two connecting bars 40. The ends of the connecting bars 40 are formed with short inward tapering segments 46. The connecting bars 40, near their lower ends are each formed with inwardly bent portions forming recesses or detents 48 along the outer side of the connecting bars 40. The end of spring elements 24B, from the detents 48 to the torsion bar 44, forms a tongue or male portion 50 which is inserted into a receiving box or female portion 52 formed at the distal end of spring elements 24A.

The receiving box 52 has two short end bars 54 at the ends of the connecting bars 40 which are transverse to the torsion bars 42. The end bars 54 are connected to lateral side segments 56 which are parallel to the torsion bars 42. The end bars 54 and side segments 56 are within a plane substantially parallel to the proximal end portion 32 of the spring element. The end bars 54 and side segments 56 define the generally rectangular receiving box 52. An inverted return bent portion 58 joins the two side segments 56 to one another approximately at the middle of the receiving box. Corners 60 are formed at the intersection of the end bars with the side segments.

Figure 8:
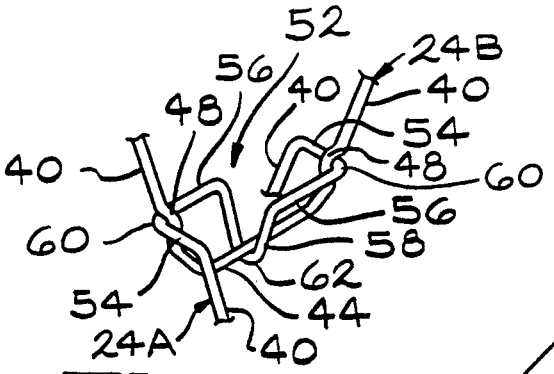
FIG. 8 is an enlarged perspective view of the connecting structures at the distal ends of a pair of the spring elements shown in a connected relationship.
Figure 9:
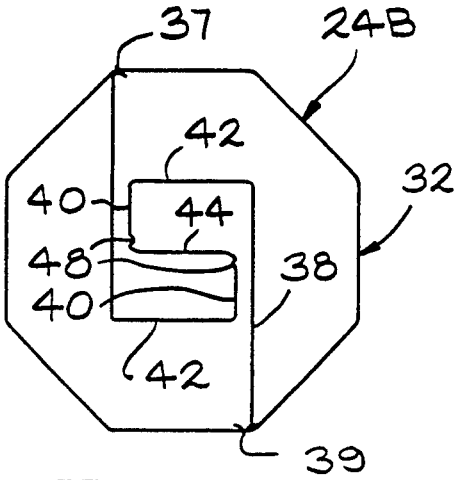
FIG. 9 is an enlarged single line schematic top view of a spring element.

The two mating spring elements are joined together by inserting the tongue 50 of element 24B into the box 52 of element 24A. As the spring element 24B engages the spring element 24A, the first contact will occur between the tapered segments 46 of element 24B and the side segments 56 of element 24A. With increasing pressure, the connecting bars 40 of spring element 24B will bend inward, toward one another, allowing the tongue 50 to be inserted into the receiving box 52 and the side segments 56 to snap fit into the detents 48. When the spring elements 24A and 24B are coupled together, the end bars 54 are seated into the detents 48 in spring element 24B adjacent to the corners 60 as shown in FIG. 8. Because the connecting bars, from the side, are V-shaped, tapering toward the distal end, the two detents 48 seat into the diagonally opposite corners 60 of the receiving box 52.

Once the two spring elements are joined together at their distal ends, they operate together as a single combined spring extending between the two spaced decks 11. During loading and deflection of the combined spring, forces are transmitted between the spring elements 24B and 24A through the contact between the detents 48 and the side segments 56. If this connection were to fail, compressive loading between the two elements would continue to be transmitted by contact of the torsion bar 44 of spring element 24B in the apex 62 of the inverted return bent portion 58. Also the confinement of the torsion bar 44 within the inverted return bent portion 58 provides lateral stability between top and bottom spring elements.

Figure 11:
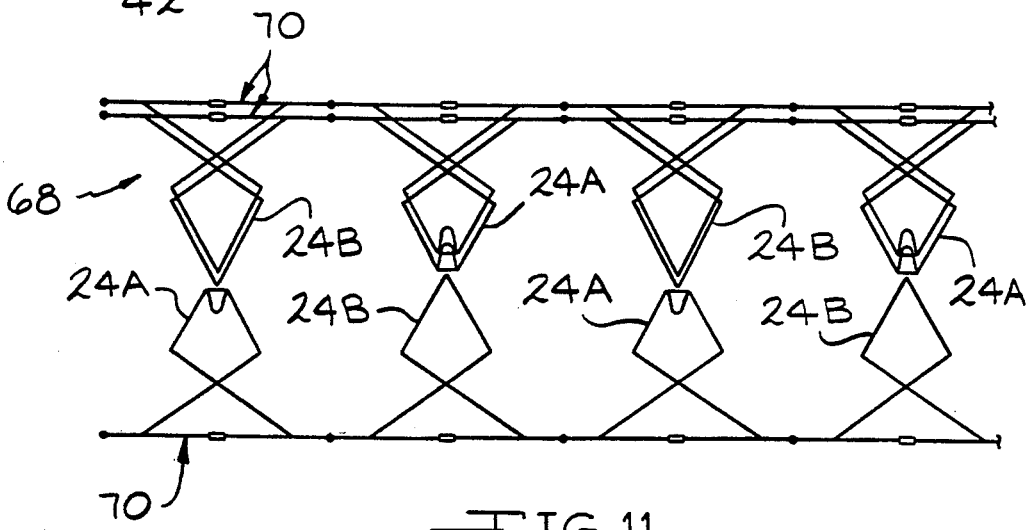
FIG. 11 is a single line schematic drawing of a stack of half units, each with both types of spring elements and with one half unit inverted, illustrating the mating relationship of the spring elements to form a wire spring assembly.

In one embodiment, all of the spring elements in the lower half unit 26 will be of the type shown as 24A having a receiving box 52. Likewise, all the spring elements in the upper half unit 28 will be of the type designated as 24B having a tongue 50 at the distal end. However, the invention is not limited to half units in which all of the spring elements are of the same type. Both elements 24A and 24B can be in the same half unit as long as they mate with a complementary spring element in the other half unit. For example, with reference to FIG. 11, a stack 68 of half units 70 are shown with both spring elements 24A and 24B included in each half unit. Below the stack 68, one half unit 70 is shown inverted with each spring element 24A of one half unit 70 mating with a spring element 24B of the other half unit 70.

Figure 10:
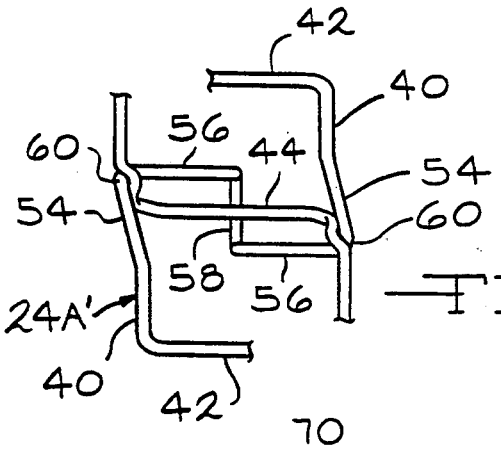
FIG. 10 is a fragmentary top view of the distal end portions of two mated spring elements with an alternative embodiment of one of the spring elements.

FIG. 10 shows two spring elements connected together with an alternative embodiment of the spring element 24A designated as 24A'. In this embodiment, the end bars 54 flare outward from the connecting bars 40 to the corners 60 such that the corners 60 are less than 90 degree corners. This provides a more confined seat for the detents 48 of the mating spring element. This will reduce twisting of the spring elements relative to one another when coupled.

The described connecting structure at the distal end portions of the spring elements is only one example of male/female connecting schemes that can be employed. Various alternative coupling structures can be used as well. In addition, attaching clips can be used to couple the two spring elements if desired.

The wire spring assembly of the present invention is formed by two half units that are preferably nestably stackable to enable a plurality of half units to be shipped in a relatively compact and safe stack. The wire spring assemblies are assembled by inverting one half unit relative to the other half unit and connecting the two half units together. In the preferred embodiment, the spring elements of the half units are formed with connecting structures at their distal ends which cooperate with one another to enable two complementary spring elements to be snapped together to join two half units without the use of separate fasteners. The wire spring assemblies thus meet the objective of the invention.

It is to be understood that the invention is not limited to the exact construction illustrated and described above, but that various changes and modifications may be made without departing from the spirit and scope of the invention as defined in the following claims.

We claim:

1. A wire spring assembly for a furniture article comprising:

a first half unit including a first generally planar deck and a plurality of first spring elements extending in one direction from said deck and terminating in distal end portions, said first spring elements deflectably supporting said first deck in a spaced relationship relative to said distal end portions;

a second half unit including a second generally planar deck and a plurality of second spring elements extending in one direction from said second deck and terminating in distal end portions, said spring second elements deflectably supporting said second deck in a spaced relationship relative to said distal end portions; and means at the distal end portions of said first and second spring elements for joining said first and second half units together with said second half unit being inverted relative to said first half unit and with the spring elements of one half unit extending toward the deck of the other half unit thereby forming said wire spring assembly with spaced first and second decks and said joined spring elements forming single combined springs between said decks.

2. The wire spring assembly of claim 1 wherein:

said decks each include a border wire having spaced opposite sides and a plurality of lacing wires extending between two of said spaced opposite sides of said border wire along generally parallel paths; and said spring elements including proximal end portions lying generally in the planes of said decks and said lacing wires being wrapped around parts of said proximal end portions to attach said spring elements to said decks.

3. The wire spring assembly of claim 1 wherein:

said means for joining said half units together includes male connecting structures at the distal end portions of half of said spring elements and complementary female connecting structures at the distal end portions of the other half of said spring elements for snap-fit engagement with said male connecting structures, said spring elements being arranged on said decks so that when one of said first half units is inverted relative to one of said second half units, each spring element having a male connecting structure is aligned with a spring element having a female connecting structure whereby said spring elements are joined together by snap-fit engagement of said connecting structures to join said half units together.

4. The wire spring assembly of claim 3 wherein:

said spring elements include a pair of spaced connecting bars extending to said distal ends, said male connecting structure including a torsion bar at said distal end between said connecting bars forming a projecting tongue at said distal end; and said female connecting structure including a generally open rectangular box at said distal end having a pair of spaced ends, said open rectangular box receiving said tongue of a spring element having a male connecting structure with the connecting bars adjacent said torsion bar engaging the ends of said open rectangular box.

5. The wire spring assembly of claim 4 wherein the connecting bars of said spring elements diverge away from said distal ends when viewed from the side whereby said connecting bars of the spring elements having male connecting structures engage said open rectangular box at opposite diagonal corners.

6. The wire spring assembly of claim 5 further comprising inwardly projecting detents in said connecting bars adjacent said torsion bar at the distal ends of said spring elements with male connecting structures for engagement with said opposite diagonal corners of said female connecting structures.

7. The wire spring assembly of claim 1 wherein:

said means for joining said half units together includes a projecting structure at the distal end portion of one spring element and a receiving opening structure at the distal end portion of a mating spring element for receiving said projecting structure in a snap-fit engagement for joining said spring elements together to join said half units together.

8. The wire spring assembly of claim 1 wherein said spring elements each outline an inside cavity having a cross sectional area parallel to said decks that increases progressively from said distal end portions to said decks and wherein said inside cavities are unobstructed from said decks whereby a plurality of said half units may be stacked together with the spring elements of one half unit being nested into the spring elements of the half unit therebelow.

9. A wire spring assembly for a furniture article comprising:

a first half unit including a first generally planar deck and a plurality of first spring elements extending in one direction from said deck and terminating in distal end portions, said first spring elements each outlining an inside cavity having a cross sectional area parallel to said first deck which increases progressively from said distal end portions to said first deck and each inside cavity being open at said first deck whereby a plurality of said first half units may be stacked together with the spring elements of one of said first half units being nested into the spring elements of the half unit therebelow;

a second half unit including a second generally planar deck and a plurality of second spring elements extending in one direction from said deck and terminating in distal end portions, said second spring elements each outlining an inside cavity having a cross sectional area parallel to said second deck which increases progressively from said distal end portions to said second deck and each inside cavity being open at said second deck whereby a plurality of said second half units may be stacked together with the spring elements of one of said second half units being nested into the spring elements of the half unit therebelow; and means at the distal portions of said first and second spring elements for joining said first and second half units together with said second half unit being inverted relative to said first half unit and with said the spring elements of one half unit extending toward the deck of the other half unit thereby forming said wire spring assembly with spaced first and second decks, said joined spring elements forming single combined springs between said decks.

10. The wire spring assembly of claim 9 wherein:

said decks each includes a border wire having spaced opposite sides and a plurality of lacing wires extending between two of said spaced opposite sides of said border wire along general parallel paths; and said spring elements including proximal end portions lying generally in the planes of said decks and said lacing wires being wrapped around parts of said proximal end portions to attach said spring elements to said decks.

11. The wire spring assembly of claim 9 wherein:

said means for joining said half units together includes male connecting structures at the distal end portions of half of said spring elements and complementary female connecting structures at the distal end portions of the other half of said spring elements for snap-fit engagement with said male connecting structures, said spring elements being arranged on said decks so that when one of said first half units is inverted relative to one of said second half units, each spring element having a male connecting structure is aligned with a spring element having a female connecting structure whereby said spring elements are joined together by snap-fit engagement of said connecting structures to join said half units together.

12. The wire spring assembly of claim 9 wherein:

said means for joining said half units together includes a projecting structure at the distal end portion of one spring element and a receiving opening structure at the distal end portion of a mating spring element for receiving said projecting structure in a snap-fit engagement for joining said spring elements together to join said half units together.

13. A half unit of a wire spring assembly comprising:

a generally rectangular border wire having spaced opposite sides;

a plurality of spaced lacing wires extending between two of said spaced opposite sides of said border wire along generally parallel paths, said lacing wires together with said border wire forming a generally planer deck;

a plurality of first and second spring elements extending in one direction from said deck between adjacent spaced lacing wires and connected to said deck by said lacing wires, said first and second spring elements terminating in first and second distal end portions respectively spaced from said deck; and complementary joining means at the distal end portions of said first and second spring elements for joining one of said first spring elements to one of said second spring elements with said second spring elements being inverted relative to said first spring elements, and said first and second spring elements being arranged on said deck so that when a first half unit is inverted relative to a second identical half unit, and the distal end portions of said first and second spring elements of said first and second half units are brought together, a first spring element of said first half unit is aligned with a second spring element of said second half unit whereby said two half units can be joined together by said joining means at the distal end portions of said first and second spring elements thus forming a wire spring assembly with spaced decks and with the spring elements of said first half unit being joined to the spring elements of said second half unit forming combined springs extending between said decks.

14. The half unit of claim 13 wherein:

said first and second spring elements each outline an inside cavity having a cross sectional area parallel to said deck that increases progressively from said distal end portions to said deck and wherein said inside cavities are unobstructed by said deck whereby a plurality of said half units may be stacked together with the spring elements of one half unit being nested into the spring elements of the half unit therebelow.

* * * * *